US011154908B2

(12) United States Patent
Buschhardt et al.

(10) Patent No.: US 11,154,908 B2
(45) Date of Patent: Oct. 26, 2021

(54) SEPARATING APPARATUS FOR POLYSILICON

(71) Applicant: SILTRONIC AG, Munich (DE)

(72) Inventors: Thomas Buschhardt, Burghausen (DE); Simon Ehrenschwendtner, Winhoering (DE); Thomas Hinterberger, Burgkirchen (DE); Hans-Guenther Wackerbauer, Muehldorf (DE)

(73) Assignee: Siltronic AG, Munich (DE)

( * ) Notice: Subject to any disclaimer, the term of this patent is extended or adjusted under 35 U.S.C. 154(b) by 197 days.

(21) Appl. No.: 16/470,006

(22) PCT Filed: Jul. 28, 2017

(86) PCT No.: PCT/EP2017/069199
§ 371 (c)(1),
(2) Date: Jun. 14, 2019

(87) PCT Pub. No.: WO2018/108334
PCT Pub. Date: Jun. 21, 2018

(65) Prior Publication Data

US 2020/0086348 A1 Mar. 19, 2020

(30) Foreign Application Priority Data

Dec. 16, 2016 (DE) ..... 102016225248.8

(51) Int. Cl.

| | |
|---|---|
| ***B07B 13/07*** | (2006.01) |
| ***B07B 1/46*** | (2006.01) |
| ***B07B 4/08*** | (2006.01) |
| ***B07B 13/16*** | (2006.01) |

(52) U.S. Cl.
CPC ..... *B07B 13/07* (2013.01); *B07B 1/4654* (2013.01); *B07B 4/08* (2013.01); *B07B 13/16* (2013.01)

(58) Field of Classification Search
CPC ..... B07B 13/07; B07B 13/16; B07B 1/4654; B07B 4/08
USPC ..... 209/670
See application file for complete search history.

(56) References Cited

U.S. PATENT DOCUMENTS 2,074,515 A * 3/1937 Pyatt ..... B07B 4/06 209/19
5,375,720 A * 12/1994 Piggott ..... B07B 4/08 209/254
5,819,951 A * 10/1998 Sultanovich ..... B07B 1/4654 209/313

(Continued)

FOREIGN PATENT DOCUMENTS

DE 43 07 138 A1 9/1994
DE 198 22 996 C1 5/1998

(Continued)

*Primary Examiner* — Terrell H Matthews
(74) *Attorney, Agent, or Firm* — Brooks Kushman P.C.

(57) ABSTRACT

A separating apparatus for polysilicon has at least one screen plate, comprising a feed region for polysilicon, a profiled region having peaks and valleys, a region having screen apertures which adjoins the profiled region, and a takeoff region, wherein the screen apertures widen in the direction of the takeoff region, and a separating plate which is horizontally and vertically displaceable is arranged below the screen apertures.

11 Claims, 2 Drawing Sheets

(56) References Cited

U.S. PATENT DOCUMENTS

| | | | | |
|---|---|---|---|---|
| 6,210,991 | B1 * | 4/2001 | Wenham | H01L 31/02363 438/97 |
| 6,260,712 | B1 * | 7/2001 | Flottmann | B07B 4/02 209/639 |
| 6,360,895 | B1 | 3/2002 | Riggenmann et al. | |
| 6,375,011 | B1 * | 4/2002 | Flottmann | B07B 1/469 198/750.1 |
| 2003/0173257 | A1 * | 9/2003 | Olsen | B07B 1/46 209/1 |
| 2008/0314805 | A1 * | 12/2008 | Hwang | E02B 8/026 209/395 |
| 2010/0001106 | A1 | 1/2010 | Schaefer et al. | |
| 2015/0090178 | A1 * | 4/2015 | Arvidson | C30B 29/06 117/23 |
| 2018/0104720 | A1 | 4/2018 | Fricke et al. | |
| 2018/0185882 | A1 | 7/2018 | Bergmann et al. | |

FOREIGN PATENT DOCUMENTS

| | | | |
|---|---|---|---|
| EP | 0139783 | A1 | 5/1985 |
| EP | 0982081 | A1 | 3/2000 |
| EP | 1 043 249 | A1 | 10/2000 |
| JP | H5168450 | A | 7/1993 |
| JP | 2002011408 | A2 | 1/2002 |
| JP | 2009544564 | A | 12/2009 |
| JP | 2018524163 | A | 8/2018 |
| WO | 94/20229 | A1 | 9/1994 |
| WO | 97/26495 | A2 | 7/1997 |
| WO | 2016165959 | A1 | 10/2016 |

* cited by examiner

SEPARATING APPARATUS FOR POLYSILICON

CROSS REFERENCE TO RELATED APPLICATIONS

This application is the U.S. National Phase of PCT Appin. No. PCT/EP2017/069199 filed Jul. 28, 2017, which claims priority to German Application No. 10 2016 225 248.8 filed Dec. 16, 2016, the disclosures of which are incorporated in their entirety by reference herein.

BACKGROUND OF THE INVENTION

1. Field of the Invention

The field of endeavour of the invention is that of separating apparatuses for polysilicon.

2. Description of the Related Art

Polycrystalline silicon (polysilicon for short) serves as a starting material for producing monocrystalline silicon for semiconductors by the Czochralski (CZ) or zone melting (FZ) processes, and for producing mono- or multicrystalline silicon by various pulling and casting processes for the production of solar cells for the photovoltaics sector.

Polycrystalline silicon is generally produced by means of the Siemens process. For most applications the thus produced polycrystalline silicon rods are crushed into small chunks which are typically then classified according to size. Typically, screening machines are used to sort/classify polycrystalline silicon into different size classes after comminution.

Alternatively, granular polycrystalline silicon is produced in a fluidized bed reactor. Once produced, the granular polysilicon is typically divided into two or more fractions or classes by means of a screening plant (classification).

A screening machine is in general terms a machine for screening, i.e. for separating solids mixtures according to particle size. A distinction is made in terms of motion characteristics between planar vibratory screening machines and shaker screening machines. The screening machines are usually driven by electromagnetic means or by imbalance motors or drives. The motion of the screen tray serves to convey the charged material further in the screen longitudinal direction and to pass the fines fraction through the screen apertures. In contrast to planar vibratory screening machines gravity screening/throw screening machines give rise to vertical as well as horizontal screen acceleration.

During crushing of polysilicon, packaging thereof and during transport, dust particles and fines fractions are formed in amounts so significant that without further screening or separation a yield loss results during crystal pulling.

There is therefore a need to separate small particles and dust from the polysilicon before crystal pulling.

However, prior art separation apparatuses such as bar screens have a tendency to become blocked during fines fraction removal. As a result these separation apparatuses must undergo cyclic cleaning and therefore do not achieve continuous, unchanging separation accuracy. This also requires plant shutdowns and additional effort for cleaning.

DE 198 22 996 C1 discloses a separation apparatus for elongate solids particles comprising a vibratory tray having a number of longitudinal grooves extending in the conveying direction to which screen apertures for separating the elongate solids particles adjoin, wherein the groove depth of the longitudinal grooves decreases in the conveying direction. To avoid blockages and to ensure the most fluid possible solids flow one embodiment provides that the screen apertures widen in the conveying direction. Solids particles jammed in the screen aperture are subjected to a force in the conveying direction by the solid that follows. The jammed solids particle may thus be moved in the conveying direction and then falls through the widening screen aperture.

However a separation of small silicon particles and dust that is as complete as possible cannot be achieved with the apparatus proposed in DE 198 22 996 C1.

The object to be achieved by the invention arose from the problems described.

SUMMARY OF THE INVENTION

The object of the invention is achieved by a separating apparatus for polysilicon having at least one screen plate, comprising a feed region for polysilicon, a profiled region having peaks and valleys, a region having screen apertures which adjoins the profiled region, and a takeoff region, wherein the screen apertures widen in the direction of the takeoff region, and a separating plate arranged below the screen apertures which is horizontally and vertically displaceable.

DETAILED DESCRIPTION OF THE PREFERRED EMBODIMENTS

Figure 1:
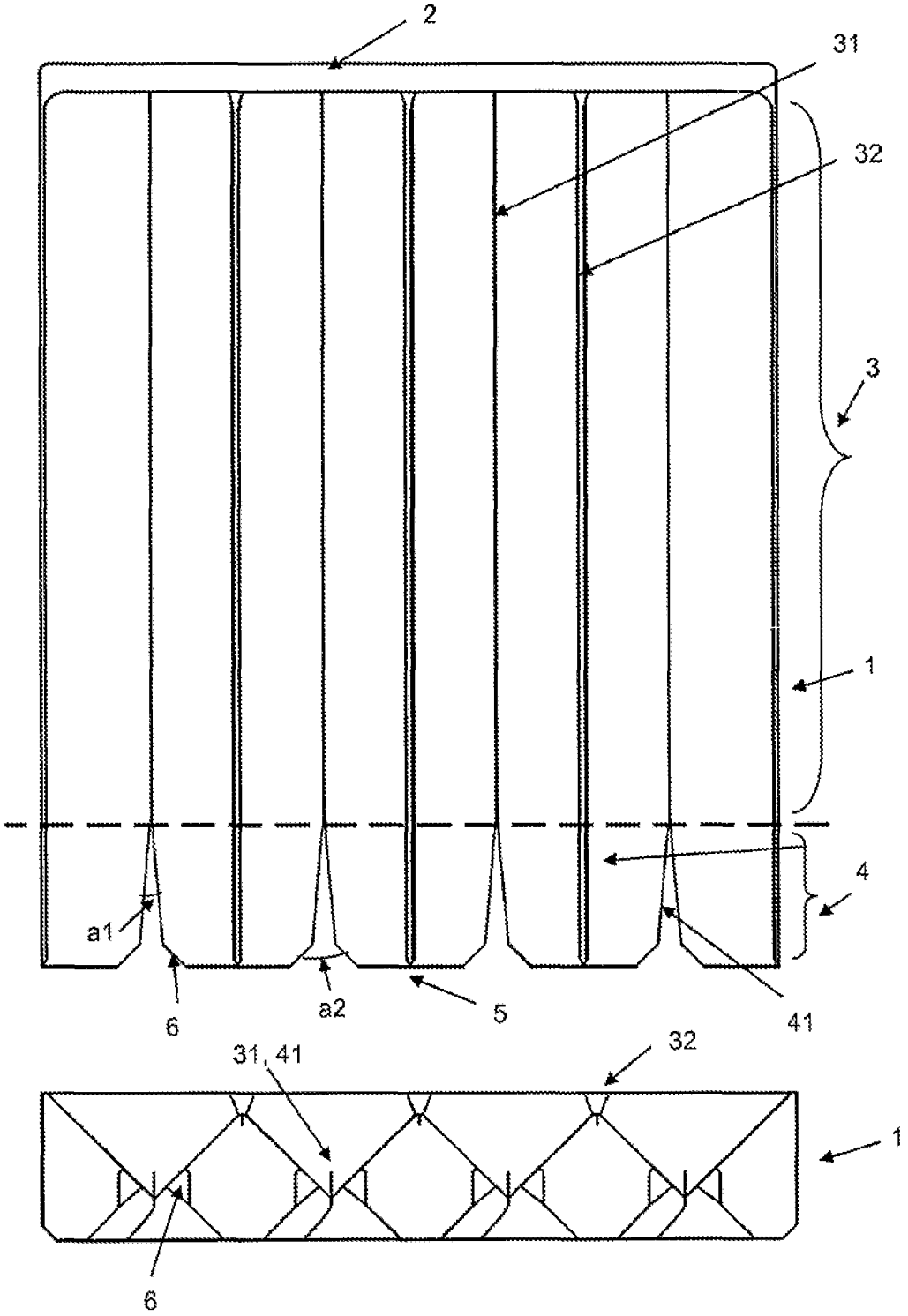
FIG. 1 shows the schematic construction of a screen plate of a separating apparatus according to the invention.
Figure 2:
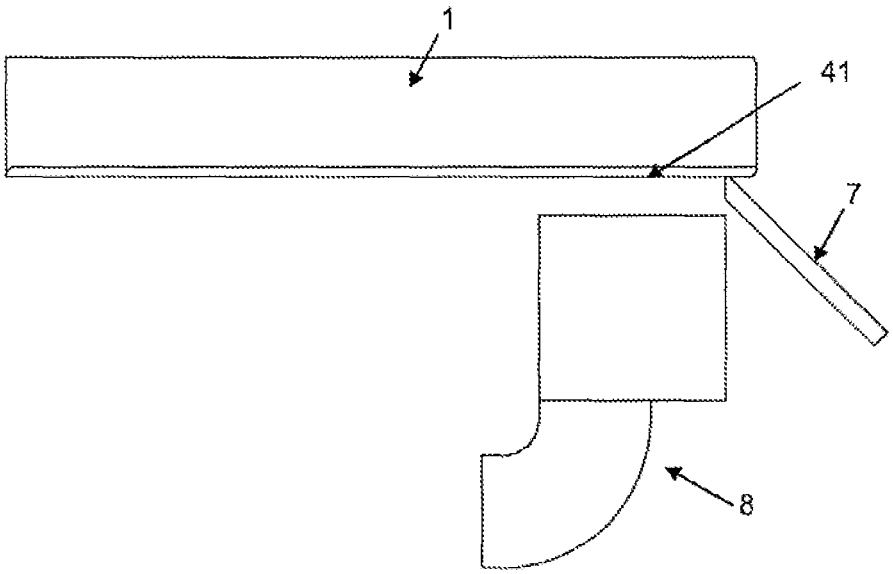
FIG. 2 is a schematic diagram of a separating apparatus having an exhaust and a separating plate.
Figure 3:
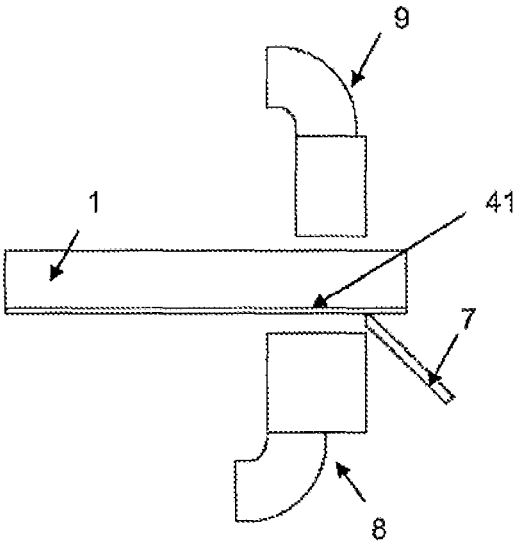
FIG. 3 is a schematic diagram of a separating apparatus having an exhaust and a gas stream.

The screen plate according to the invention provides a separating plate arranged below the screen apertures/the region with screen apertures.

The position of the separating plate in the conveying direction/in the direction of the takeoff region may be varied since the separating plate is horizontally displaceable.

Likewise, the separating plate may also be displaced vertically so that the distance to the screen apertures may be varied.

It has been found that this is necessary to increase separation sharpness and to ensure the most uniform possible separation rate.

A displacement of the separating plate in the conveying direction allows the effective size of the screen apertures to be varied. For example the separating plate may be arranged such that polysilicon of not more than 4 mm in size falls through the screen aperture and via the separating plate is separated from the remaining polysilicon.

In addition, the separating plate may be angled against the vertical such that the separated polysilicon is received in a collection container while larger polysilicon likewise falls through the screen apertures but is received in another collection container arranged downstream of the separating plate in the conveying direction.

Thus the screen plate in conjunction with the separating plate also allows two fractions to be separated from the polysilicon feed.

Variation of the vertical distance of the separating plate to the screen apertures makes it possible to ensure that elongate polysilicon chunks are not separated.

The separating plate can thus fulfill very different functions.

The object is also achieved by a process, wherein polysilicon is fed onto the screen plate of a separating apparatus according to the invention, which is set into vibration such that the polysilicon executes a motion in the direction of the takeoff region, wherein small-particle-size polysilicon collects in the valleys of the screen plate and falls through the screen apertures of the screen plate via the separating plate into a collection container and is thus separated from the polysilicon feed, wherein the polysilicon feed is subjected to further processing without the separated small-particle-size polysilicon.

In one embodiment the position and height of the separating plate is chosen as a function of the severity with which the polysilicon has been set into vibration. The separating plate preferably has a distance to the screen plate of 5 mm to 20 mm; a distance of 1 mm to 5 mm is particularly preferred.

Small-particle-size polysilicon is to be understood as meaning a portion of the polysilicon feed amount which is to be removed by means of the screening plant. The small-particle-size polysilicon is thus the fraction to be separated.

Hereinbelow, small-particle-size polysilicon is to be understood as meaning polycrystalline chunks whose longest distance between two points on the surface of a silicon chunk (=maximum length) is not more than 4 mm. This shall also comprise a fines fraction, small silicon particles and silicon dust (size not more than 100 μm).

The screen plate comprises a feed region in which feeding of the polysilicon is effected.

In one embodiment the polysilicon is conveyed to the screening plant and delivered to the feed region of the screen plate by means of a conveying channel.

The screen plate further comprises a profiled region having flutes or grooves or generally depressions and elevations/tips so that the profiled region has valleys and peaks.

During the motion of the polysilicon on the profiled region small chunks or small silicon particles (small with respect to the target fraction) or fines fraction collect(s) in the valleys of the profiled region.

The screen plate comprises—adjoining the profiled region—a region having screen apertures. The screen apertures are arranged immediately downstream of the valleys of the profiled region in the conveying direction. As a result the fines fractions of the polysilicon present in the valleys of the profiled region are selectively passed to the screen apertures.

In one embodiment the peaks of the profiled region also continue into the region having screen apertures so that the entire screen plate is profiled, the screen plate, however, having screen apertures instead of valleys at its rear end in the conveying direction.

In terms of cross section and angle the profile of the profiled region may here differ from the profile in the region of the screen apertures. The latter may be advantageous in particular when the screen plate or the parts of the screen plate coming into contact with the polysilicon are made of plastic.

The removal of the fines fraction or of small chunks/particles is thus effected via the screen apertures of the screen plate in conjunction with the separating plate.

In one embodiment the removed fines fractions or small chunks/particles are received by a collection container arranged below the screen apertures of the screen plate.

Larger chunks are passed over the peaks of the profiled region to the takeoff region.

In one embodiment the takeoff region is connected to a conveying channel through which the larger chunks are discharged. It is likewise possible for there to be a further adjoining screen plate to remove a further fraction from the polysilicon.

The invention thus provides a screen plate which may be employed in all types of screening apparatuses, where the fines fraction or small-particle-size silicon collects in valleys in the first region of the screen plate and is selectively separated through widening screen apertures in the last region of the screen plate.

The implementation of the profiled region of the screen plate depends on the fraction to be separated. The depth and the angle of the valleys of the profiled region are to be configured such that the fraction to be separated, i.e. the fines fraction for example, collects there.

The invention thus concerns a screen plate where the fines fraction collects in valleys in the first region of the apparatus and is selectively separated through widening screen apertures in the last region of the apparatus. The screen slot is thus not supplied with the entire fraction.

The separation apparatus consists essentially of a screen plate which may be divided into two regions. The first region is the intake region. In this region the fines fraction collects in the valleys and is thus selectively supplied to the screen apertures (which are located in the second region at the end of the screen plate). The separating step for the separation is effected in the second region of the screen plate via screen apertures introduced therein which widen in the conveying direction. Separation of the desired Si fraction/of the fines fraction is effected via these screen apertures. Since these screen apertures widen in the conveying direction this system does not have a tendency to become blocked.

In one advantageous embodiment the screen apertures extend to the end of the separating apparatus situated in the conveying direction. The screen apertures are therefore formed so as to be open toward the end. This is an essential feature to ensure that no silicon chunks collect in the separation apparatus and that the screen aperture does not become blocked.

The screen apertures preferably have an aperture angle of 1 to 20° and more preferably of 5-15°.

The screen apertures preferably have a length of 5 mm to 50 mm, more preferably a length of 20 to 40 mm.

To avoid blockages a further advantageous embodiment provides that the screen apertures widen further at the end in the conveying direction.

The aperture angle of this second widening is preferably 40-150°; an aperture angle of 60 to 120° is more preferable.

In one embodiment the angle of the screen apertures may be altered by suitable apparatuses. This may be achieved for example using elements made of an elastic material. It has been found that this is advantageous for avoiding lodged grains.

In a preferred embodiment an exhaust is mounted under the screen apertures in the separating apparatus and is positioned such that the exhaust is preferably located between the beginning of the screen apertures and the separating plate.

The exhaust preferably has a distance to the lower screen plate of 1 mm to 50 mm; a distance of 5 mm to 20 mm being particularly preferred.

A further preferred embodiment of the separation according to the invention is the installation of a gas stream above the screen apertures. This installation comprises one or more gas nozzles which are directed at the screen apertures.

Depending on the configuration of the gas nozzles the gas jet may be softer or harder.

A soft jet is preferably suitable for assisting the separation of the dust. By contrast, a hard jet is preferably suitable for separation of the smaller polysilicon chunks, 0.1 mm to 4 mm. The gas stream may also be in the form of a laminar flow.

Contemplated gases include cleanroom air according to DIN EN ISO 14644-1 (ISO1 to ISO6), clean drying air, nitrogen and argon.

The gas stream is preferably positioned between the beginning of the screen apertures and the separating plate.

In one embodiment the takeoff region is connected to a conveying channel through which the larger chunks are discharged. It is likewise possible for there to be a further adjoining screen plate, to remove a further fraction from the polysilicon.

In one embodiment the screen plate is made of one or more materials selected from the group consisting of plastic, ceramic, glass, diamond, amorphous carbon, silicon or metal, metal lined with quartz glass and metal lined with silicon.

In one embodiment the screen plate is lined or coated with of one or more materials selected from the group consisting of plastic, ceramic, glass, diamond, amorphous carbon and silicon.

In one embodiment the parts of the screen plate coming into contact with the polysilicon are lined or coated with of one or more materials selected from the group consisting of plastic, ceramic, glass, diamond, amorphous carbon and silicon.

In one embodiment the screen plate comprises a metallic base body and a coating or lining made of one or more materials selected from the group consisting of plastic, ceramic, glass, diamond, amorphous carbon and silicon.

In one embodiment the screen plate comprises a base body made of plastic and a coating or lining made of one or more materials selected from the group consisting of ceramic, glass, diamond, amorphous carbon and silicon.

In one embodiment of the invention the plastic used in the abovementioned embodiments is selected from the group consisting of PVC (polyvinyl chloride), PP(polypropylene), PE (polyethylene), PU (polyurethane), PFA (perfluoralkoxy), PVDF(polyvinylidene fluoride) and PTFE (polytetrafluorethylene).

In one embodiment the screen plate comprises a coating of titanium nitride, titanium carbide, aluminum titanium nitride, DLC (diamond-like carbon), silicon carbide, nitride-bonded silicon carbide or tungsten carbide.

Preferably, the chunk sizes (CS) 1, 2, 3 may be employed via this screening apparatus. These chunk sizes typically have the following dimensions.

| | |
|---|---|
| Chunk size 1 | 3 to 15 mm |
| Chunk size 2 | 10 to 40 mm |
| Chunk size 3 | 20 to 60 mm |

The individual chunk size classes typically comprise smaller and larger chunks. The proportion of larger and smaller chunks may be up to 5% in each case.

The screening apparatus is suitable in particular for separation of small polysilicon pieces having a diameter of for instance 0.05 to 2 mm and typically a length of up to 4 mm.

In a further embodiment the screening apparatus comprises a funnel for feeding polysilicon material, two conveying units and two screen plates, wherein a screen plate follows every conveying unit. One conveying unit and one screen plate form one unit. The first unit is described as unit 1 and the second unit is described as unit 2. The conveyed amount of polysilicon in kg/min may be adjusted separately for each unit. It is preferable when the conveyed amount for unit 1 is the same as for unit 2.

It is particularly preferable when the conveyed amount for unit 1 is smaller than the conveyed amount for unit 2 because this allows a singularization of the polysilicon chunks to be established on unit 2 with the result that the small polysilicon chunks and the dust can be better separated.

It will be appreciated that a plurality of units may be also mounted in series.

Such a measure improves the separation of small polysilicon pieces and of dust.

A takeoff region is located at the end of the last screen plate.

The takeoff region is shaped such that the polysilicon material slides into the container provided.

This takeoff region may likewise be set into vibration to ensure that no polysilicon material is left behind.

The angle of this outlet is preferably 5 to 45° and more preferably 15 to 25°.

No blockage of the screen occurs and thus identical screening quality is achieved. The purification steps may therefore be eschewed (increasing equipment uptime, reducing personnel costs). In comparison with bar screens, the separation is more precise, so that the loss rate is reduced.

The features cited in connection with the above described embodiments of the method according to the invention may be correspondingly applied to the apparatus according to the invention. Conversely, the features cited in connection with the above described embodiments of the apparatus according to the invention may be correspondingly applied to the method according to the invention. These features of the invention and the features recited in the claims and also in the description of the figures may be realized either separately or in combination as embodiments of the invention. Said features may further describe advantageous implementations eligible for protection in their own right.

LIST OF REFERENCE NUMERALS EMPLOYED

1 Screen plate
2 Feed region
3 Profiled region of screen plate
31 Valleys of profiled region
32 Peaks of profiled region
4 Region having screen apertures
41 Screen aperture having aperture angle a1
5 Takeoff region
6 Widening having aperture angle a2
7 Separating plate
8 exhaust
9 Gas stream feed The screen plate 1 comprises a feed region 2 in which feeding of the polysilicon is effected. The polysilicon may be conveyed to the screening plant and delivered to the feed region 2 of the screen plate 1 by means of a conveying channel for example.

The screen plate 1 further comprises a profiled region 3. This profiled region 3 provides flutes or grooves or depressions of another kind so that the profiled region 3 has valleys 31 and peaks 32.

The fines fraction present in the polysilicon collects during the motion of the polysilicon on the profiled region 3 in the valleys 31 of the profiled region 3.

The screen plate 1 comprises—adjoining the profiled region 3—a region 4 having screen apertures 41. The screen apertures 41 are arranged immediately downstream (in the conveying direction) of the valleys 31 of the profiled region 3. As a result the fines fractions of the polysilicon present in the valleys 31 of the profiled region 3 are selectively passed to the screen apertures 41 of the region 4.

The peaks 32 of the profiled region 3 preferably also continue in the region 4 so that the entire screen plate 1 is profiled but in region 4 has screen apertures 41 instead of valleys 31.

The separation of the fines fraction is thus effected via the screen apertures 41 of the screen plate 1. The separated fines fractions may be received by a collection container arranged below the screen apertures 41 of the screen plate 1 for example.

Larger chunks are passed over the peaks 32 of the profiled region to the takeoff region 5.

The screen apertures 41 widen in the conveying direction by an aperture angle a1. The screen apertures 41 have at the end of region 4 a further widening 6 characterized by an aperture angle a2.

In a preferred embodiment an exhaust 8 is mounted under the screen apertures 41 in the separating apparatus and is positioned such that the exhaust 8 is preferably located between the beginning of the screen apertures 41 and the separating plate 7.

A further preferred embodiment of the separation according to the invention is the installation of a gas stream 9 above the screen apertures 41.

Examples

The polysilicon material delivered in the bag by the polysilicon producer also contains smaller chunks and fines materials. The fines material, in particular having grain sizes smaller than 4 mm, has a negative effect on the pulling process and must therefore be removed before use. Poly chunk size 2 was used for the test.

The polysilicon material used for the test having poly chunk sizes 2 was screened with a test screen (DIN ISO 3310-2) having a nominal hole width W=4 mm (square perforation) and made available for the tests. The separated fines material was collected and weighed.

10 kg of test polysilicon material of chunk size 2 (without fines material <4 mm) were fed onto a conveying unit. The feeding of the test polysilicon material is preferably undertaken via a funnel. The container to be filled is positioned over the first conveying unit at the end of the screen plate so that the test polysilicon material may be readily conveyed into the container.

The fines material separated previously for the test is used for this test. When filling the conveying unit 2 g of separated fines material are added after every 2 kg of test poly material so that in the end a sum total of 10 g of fines material were added for this test.

The conveying unit and the screen plate were then started. The conveying quantity was set to 3 kg+/−0.5 kg per minute before the test. The removed fines material was collected and reweighed. The tests were undertaken five times per setting.

Table 1 shows the average results:

Test 1

This was performed using one conveying unit plus one screen plate without an exhaust and without a gas stream from above.

Test 2

This was performed using one conveying unit plus one screen plate with an exhaust but without a gas stream from above.

Test 3

This was performed using one conveying unit plus one screen plate with an exhaust and with a gas stream from above.

Test 4

This was performed using two conveying units plus two screen plates without an exhaust and without a gas stream from above, a screen plate following each conveying unit.

Test 5

This was performed using two conveying units plus two screen plates with an exhaust and without a gas stream from above, a screen plate following each conveying unit.

TABLE 1

| Test | Amount of CS2 poly in kg | Added fines material in g | Removed fines material in g | Removal rate in % |
|---|---|---|---|---|
| 1 | 10 | 10 | 8.3 | 83 |
| 2 | 10 | 10 | 9.0 | 90 |
| 3 | 10 | 10 | 9.1 | 91 |
| 4 | 10 | 10 | 9.1 | 91 |
| 5 | 10 | 10 | 9.6 | 96 |

The results show that the use of an exhaust and a gas stream from above results in an 8% improvement in the removal rate.

A further improvement in the removal rate is possible when two screen plates are used and an exhaust is provided.

In one embodiment the separation apparatus thus comprises two screen plates, each comprising a feed region for polysilicon, a profiled region having peaks and valleys, a region having screen apertures which adjoins the profiled region, and a takeoff region, wherein the screen apertures widen in the direction of the takeoff region, and a separating plate arranged below the screen apertures which is horizontally and vertically displaceable and also an exhaust below the screen apertures. The takeoff region of the first screen plate adjoins the feed region of the second screen plate, i.e. polysilicon not separated in the first screen plate is fed onto the second screen plate. Exhausts are provided below the screen apertures for both screen plates.

The above description of illustrative embodiments is to be understood as being exemplary. The disclosure made thereby enables a person skilled in the art to understand the present invention and the advantages associated therewith and also comprehend alterations and modifications to the described structures and processes that are obvious within the understanding of a person skilled in the art. All such alterations and modifications and also equivalents shall therefore be covered by the scope of protection of the claims.

The invention claimed is:

1. A separating apparatus for polysilicon, the separating apparatus comprising at least one screen plate comprising a feed region for polysilicon, and on a top surface thereof, a profiled region having peaks and valleys which extend in a takeoff direction, a region having screen apertures adjoining the profiled region, a takeoff region, and a separating plate arranged below the screen apertures which is horizontally displaceable so as to change its position in the takeoff direction and vertically displaceable so as to change its distance to the screen apertures, wherein individual screen apertures widen in the takeoff direction.

2. The separating apparatus of claim 1, wherein an aperture angle of widening of the screen apertures is not less than 1° and not more than 20°.

3. The separating apparatus of claim 2, wherein the aperture angle of widening of the screen apertures is not less than 5° and not more than 15°.

4. The separating apparatus of claim 1, wherein the screen apertures have a length of 5 mm to 50 mm.

5. The separating apparatus of claim 4, wherein the screen apertures have a length of 20 mm to 40 mm.

6. The separating apparatus of claim 1, wherein in the direction of the takeoff region after a first widening the screen apertures widen a second time, wherein an aperture angle of this second widening is 40-150°.

7. The separating apparatus of claim 6, wherein an aperture angle of the second widening is 60 to 120°.

8. The separating apparatus of claim 1, comprising an exhaust below the screen apertures.

9. The separating apparatus of claim 1, further comprising an apparatus for directing a gas stream onto the screen apertures from above.

10. A process for classifying polysilicon, comprising:

feeding polysilicon onto the screen plate of a separating apparatus of claim 1 and setting the screen plate into vibration such that the polysilicon executes a motion in the direction of the takeoff region, wherein small-particle-size polysilicon collects in the valleys of the screen plate and falls through the screen apertures of the screen plate via the separating plate into a collection container and is thus separated from the polysilicon feed, and wherein the polysilicon feed is subjected to further processing without the separated small-particle-size polysilicon.

11. The separating apparatus of claim 1, wherein ends of the screen apertures are open in the takeoff direction.

* * * * *